United States Patent [19]

Rose

[11] Patent Number: 4,891,924

[45] Date of Patent: Jan. 9, 1990

[54] CLADDING ASSEMBLY

[76] Inventor: Derrick B. Rose, Waterloo Cottage, Pen-y-Pound, Abergavenny, Gwent, NP7 7RN, United Kingdom

[21] Appl. No.: 244,418

[22] Filed: Sep. 14, 1988

[51] Int. Cl.[4] ..... E04D 3/362; E04D 3/30

[52] U.S. Cl. ..... 52/520; 52/542; 52/543; 52/551

[58] Field of Search ..... 52/520, 543, 551, 518, 52/519, 533, 542

[56] References Cited

U.S. PATENT DOCUMENTS

| | | | |
|---|---|---|---|
| 1,963,583 | 6/1934 | Jenkins | 52/520 |
| 3,110,130 | 11/1963 | Trachtenberg | 52/520 |
| 3,142,937 | 8/1964 | Ess | 52/520 |
| 3,375,622 | 4/1968 | Murray . | |
| 3,583,117 | 6/1971 | Roach et al. . | |
| 3,945,166 | 3/1976 | Hosoda et al. . | |
| 3,998,021 | 12/1976 | Lewis . | |
| 4,009,548 | 3/1977 | Hicks . | |
| 4,040,224 | 8/1977 | Harris . | |
| 4,186,538 | 2/1980 | Marcum, Jr. . | |
| 4,292,781 | 10/1981 | Chalmers | 52/551 |
| 4,435,933 | 3/1984 | Krowl . | |
| 4,602,469 | 7/1986 | Nuckel, Jr. . | |
| 4,610,121 | 9/1986 | Schenach | 52/543 |
| 4,729,202 | 3/1988 | Ferland | 52/520 |

FOREIGN PATENT DOCUMENTS

| | | | |
|---|---|---|---|
| 468407 | 12/1972 | Australia . | |
| 638895 | 11/1959 | Italy | 52/520 |
| PCT/AU85/-00325 | 7/1986 | PCT Int'l Appl. . | |
| 817238 | 7/1959 | United Kingdom | 52/520 |
| 1106853 | 3/1968 | United Kingdom . | |
| 1440327 | 6/1976 | United Kingdom . | |
| 1520897 | 8/1978 | United Kingdom . | |
| 1589612 | 5/1981 | United Kingdom . | |
| 1591350 | 6/1981 | United Kingdom . | |
| 2151274A | 7/1985 | United Kingdom . | |

*Primary Examiner*—John E. Murtagh

*Attorney, Agent, or Firm*—Larson and Taylor

[57] ABSTRACT

To avoid the need for nailing through tiles and other cladding elements, they are formed with oppositely directed hook formations at opposite edges for engaging supports, which may be retaining profiles mounted on battens. For example, an upwardly facing hook formation is engageable under a downwardly directed supporting tongue of a profile when the element is tilted. It can then be pivoted about that tongue, into its cladding configuration. Its other hook formation snap-engages behind the tongue of the adjacent supports, which already engages the upwardly facing hook portion of another cladding element. Each support profile extends for most the width of one or more elements and provides support.

6 Claims, 3 Drawing Sheets

CLADDING ASSEMBLY

BACKGROUND OF THE INVENTION

The present invention relates to a cladding assembly and method, e.g. for tiling a roof.

In a conventional method for cladding a pitched roof, an array of longitudinally extending parallel battens is mounted to the roof, the spacing of the battens corresponding to the intended spacing of the tiles. Tiles are then laid on the battens, and secured in place. This securement is generally effected by nailing, several nails being required for each tile. Plainly this is time-consuming. It brings a risk of introducing points of leakage, particularly as the roof weathers. A tile is secured only at a few locations. The result may be unsightly.

SUMMARY OF THE INVENTION

The present invention makes possible a rapid cladding method in which it is unnecessary to apply nails or other securing means to the exterior of the tiles. Thus, cladding elements (such as tiles) and supports may be mutually adapted to allow snap-engagement. A cladding element is provided with a pair of oppositely facing hook formations at opposite edges, and the support means provide tongues for engaging a pair of different hook formations provided by an adjacent pair of cladding elements. The tongues are provided by retaining profiles which may be connected to supports such as conventional battens. Each profile is adapted to support an adjacent cladding element. Each profile extends for at least a substantial part of the width of a cladding element, and may extend across a plurality of cladding elements, e.g. across an entire roof or other clad surface. Thus a cladding element can be supported for substantially its whole extent. The tongues and/or the hook formations should have some resilience to facilitate engagement. Preferably the arrangement is such that one hook formation of a cladding element can be offered up to hook behind a tongue when the element is projecting away from its cladding configuration; after engagement, the element can then be moved to its cladding configuration, with its other hook formation finally engaging the tongue of an adjacent support means. This support means may already be engaging the tongue of opposite type of the adjacent cladding element.

A preferred form of retaining profile has a formation for engaging a batten or other support; a tongue; and a support flange for extending in the cladding direction beneath the tongue, so as to provide support for an end region of a cladding element whose hook portion is engaged with the tongue.

In another aspect the invention provides a method of cladding a surface by providing supports having tongues and cladding elements having hook portions, and mutually engaging them generally as indicated above.

In another aspect the invention provides a kit of parts for cladding a surface, including such hooked cladding elements, and support means which provide tongues, and which may comprise retaining profiles.

DESCRIPTION OF THE PREFERRED EMBODIMENTS

Figure 1:
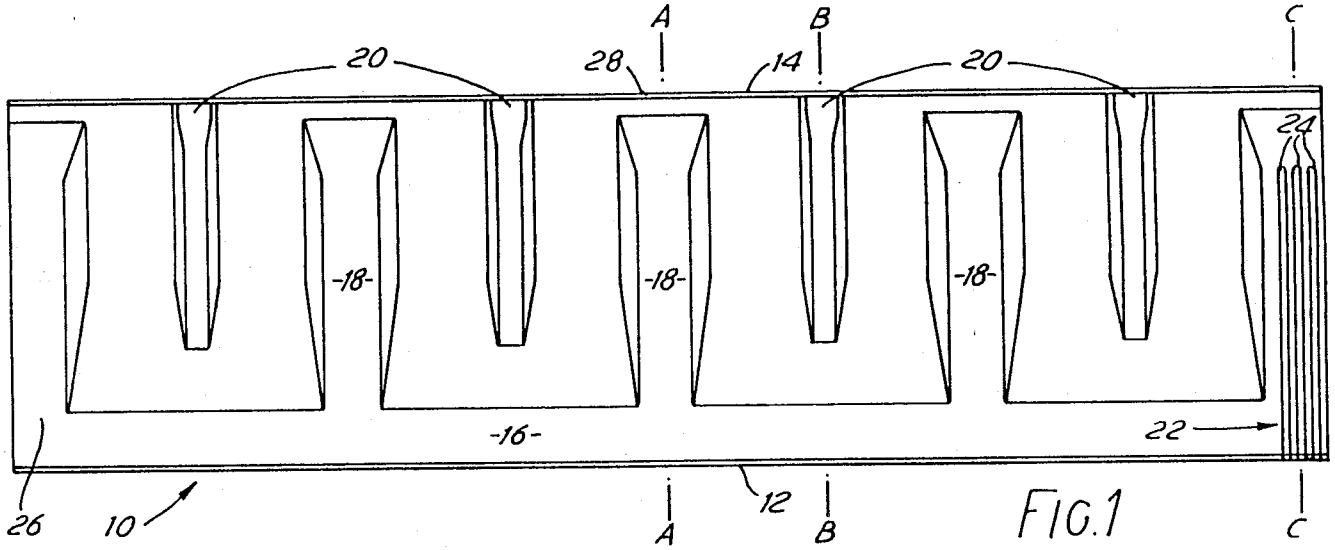
FIG. 1 is a plan view of a tile.

The tile 10 shown in FIGS. 1 to 5 is generally rectangular in plan, having long front and rear edges 12,14. It is profiled, with a raised region 16 adjacent the front edge from which ridges 18 run rearwardly towards the rear edge 14. Between the ridges 18 there are smaller ridges 20 extending forwardly from the rear edge 14. At one lateral side (the right as seen in FIG. 1) there is a low overlap area 22 with a plurality of small ridges 24. At the other lateral edge there is a complementary portion 26 which provides a socket in which the right-hand portion 22 of an adjacent tile is engageable.

At the rear edge there is an upstanding flange 28. As can be seen from the sectional views of FIGS. 3 to 5, this provides an upwardly open hook formation 30 at the rear of the tile, whereas the raised region 16 at the front provides a downwardly open hook portion 32. This has a front edge delimited by a flange whereof an upper portion 34 extends downwardly and forwardly, and a final portion 36 extends downwardly and rearwardly.

Such a tile may conveniently be formed of a resin/-glass composite material. This can easily be produced by conventional resin injection techniques, using inexpensive plant.

Figure 6:
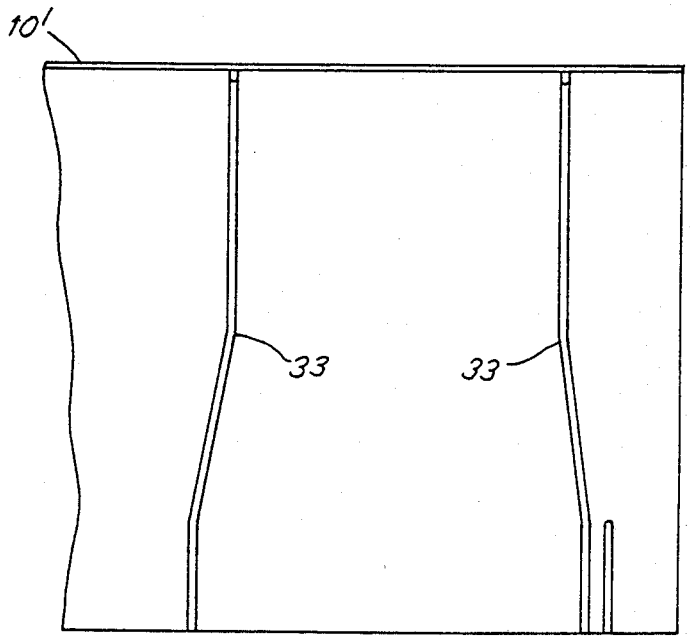
FIGS. 6 and 7 are details in plan and front elevation of a modified tile.
Figure 7:
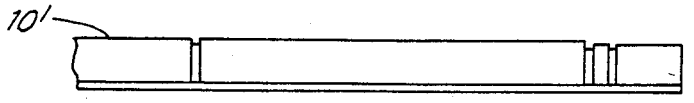

FIGS. 6 and 7 show end regions of a tile 10' generally similar to the tile 10 of the preceding figures, but having a series of grooves 33 running from front to rear, so as to provide downward projections. The grooves are also indicated in broken lines, in FIGS. 3 and 8.

Figure 8:
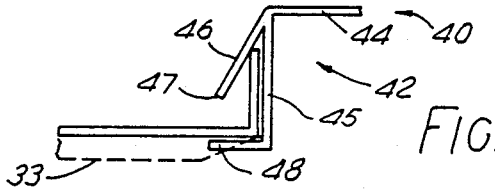
FIG. 8 is an end elevation of a tile retaining profile supporting a tile.

FIG. 8 shows a tile retaining profile 40. This is a plastics extrusion which has to be fairly tough but with some resilience. A suitable material has been found to be a semi-rigid ABS, 1mm thick. The profile presents a rear batten-engaging formation 42, in this example provided by a pair of wall portions 44, 45 at right-angles. On the other side, the profile has a downwardly and forwardly extending tongue or flange 46 which terminates with a free end 47 some way above the bottom end of the wall 45. The wall 45 has a forwardly extending flange 48, which extends beneath the end 47 of the flange 46. A tile 10 is shown, supported by the flange 48 which extends for its whole width. The tiles rear flange 28 is hooked under the tongue 46. If the tile has grooves or ribs 33, these tend to deform the profile, and cause the rear flange 28 of the tile 10' to be urged up behind the tongue 46. It can be seen that the leading edges of the ribs are angled to assist engagement.

Figure 9:
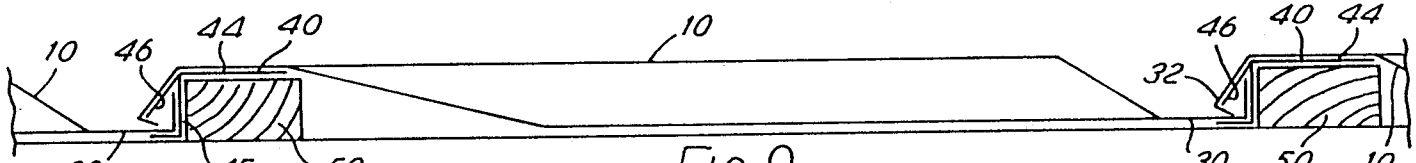
FIG. 9 is a schematic section through a portion of a roof incorporating tiles and profiles as shown in the preceding figures.

FIG. 9 shows a portion of a roof which slopes downwardly from right to left, and bears horizontally extending wooden battens 50. These are of rectangular section, and each bears a tile retaining profile 40, being embraced by the walls 44, 45 thereof. The profiles 40 are secured to the battens 50, e.g. being nailed through, so that the tongues 46 project from the lower sides of the battens. Once the profiles 40 have been attached, the tiles 10 can be mounted. Starting at a lower edge region, the rear hook formation 30 of a tile is hooked under the angled flange 46 of a profile, with the tile initially held approximatey at right-angles to the flange 46, and then laid down as shown. The next higher tile can then be applied, by engaging its upper hook formation 30 in the next highest batten's profile 40, and laying it down by pivoting anti-clockwise until it abuts the lower batten 50, and its front hook formation 32 snap-engages behind the flange 46 of its profile 40. Of course, the spacing of the battens 50 must correspond to the lengths of the tiles (though some minor adjustment is possible by the mounting of the profiles 40). In this manner the tiles can be swiftly and efficiently engaged, without the need for any nailing, or indeed any external fixing elements.

If it is desired to remove a tile, use may be made of an implement having a wide blade with an upturned lip with which one can hook the inturned flange portion 36 of the front hook 32 of a tile, and pull it free of the profile 40.

As an example of dimensions, with a tile of width about 370 mm (from front to back) and height about 30 mm, a profile 40 may be of ABS which is 1 mm thick, with the flange 46 about 18 mm long, its free end 47 being 10 mm from the wall 46 and 7 mm from the bottom flange 48.

Figure 2:
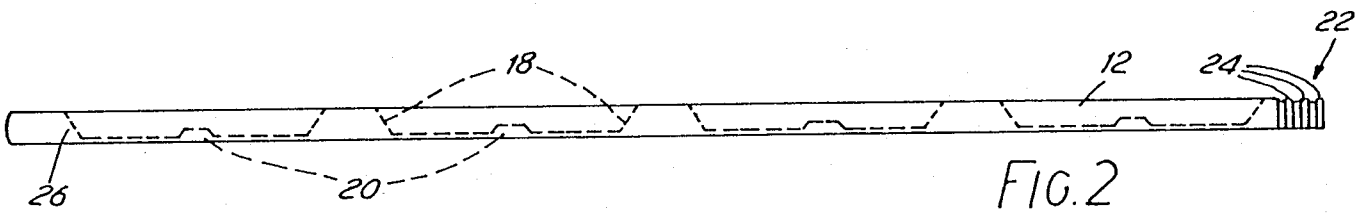
FIG. 2 is a front elevation of the tile.
Figure 3:
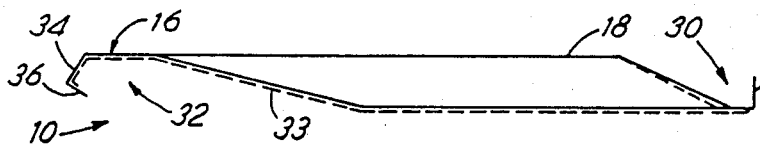
FIGS. 3,4 and 5 are sections on lines A—A, B—B and C—C respectively in FIG. 1.
Figure 4:
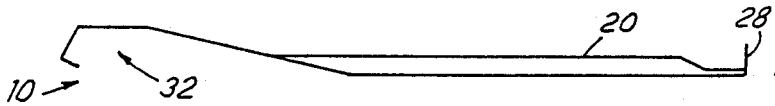
Figure 5:
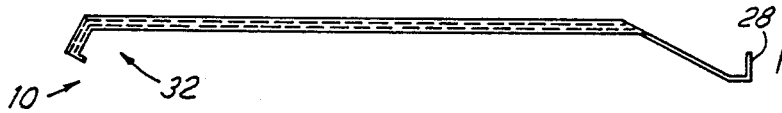
Figure 10:
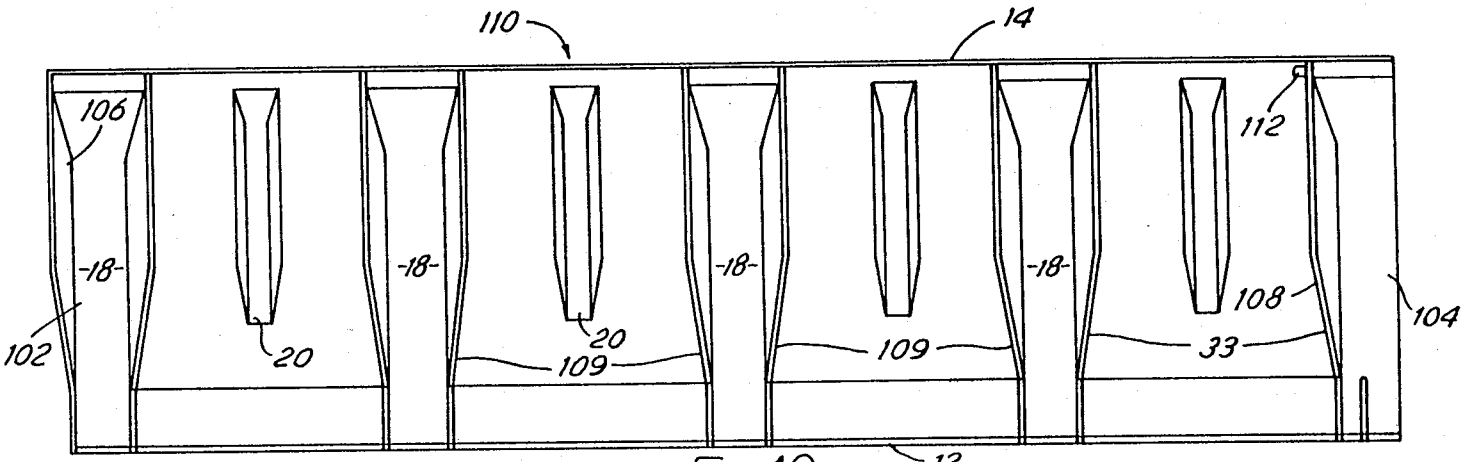
FIGS. 10 and 11 are views similar to FIGS. 1 and 2 but showing a modified embodiment.
Figure 11:
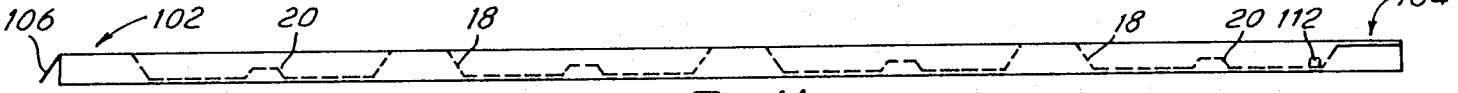

The tile 110 shown in FIGS. 10 and 11 is in most respects similar to that of FIGS. 1 and 2. Its plan is similar, with opposed long edges 12,14 where there are hook formations; short edge regions for lateral overlap; and a pattern of large (18) and small (20) ridges. However, the regions 102,104 for lateral overlap are different. At one end, the overlap region 102 is provided by a large ridge 18, terminating with a downwardly and outwardly extending flange 106. The opposite region 104 resembles a cut-off ridge 18, and can be overlaid by the other region 102 of an adjacent tile 110, with its end flange 106 sitting in the relatively recessed drainage channel 108. The tile is also shaped to provide drainage channels 109 suitable for end barge cappings to sit in.

Near the rear flange 28 and adjacent the overlaid overlap region 104, there is an upward projection 112. When tiles are being located side by side, they are pushed together so that the overlap regions 102,104 engage. The projection 112 makes it very easy to achieve this accurately. Generally, a course of tiles will be laid side by side before the tiles of the next higher course are laid.

Whereas the invention has been described with reference to preferred embodiments, the skilled reader will appreciate that changes and modifications may be made without departing from the spirit and scope of the invention. It is intended that all such changes and modifications should be included within the scope of the appended claims.

I claim:

1. A cladding assembly comprising a plurality of cladding elements and a plurality of supports therefor; wherein each cladding element has a first hook formation at a first edge region, and a second hook formation at a second, opposite edge region, the first and second hook formations being oppositely directed; and each support is adapted to be mounted to a batten of quadrilateral section, each support having three flanges in a stepped array comprising (a) a first flange for overlying an outer surface of the batten, (b) a second flange extending inwardly from the first flange, and (c) a third flange extending from the inner end of the second flange, said first and second flanges being arranged to engage said batten and provide an attachment portion whereby the support is attachable to the batten of a structure to be clad; said support further including a tongue extending from adjacent the junction of the first and second flanges towards the third flange at an angle to the second flange, said tongue providing engagement means for engaging a mutually adjacent pair of first and second hook formations provided by an adjacent pair of cladding elements which extend away from the support in opposite senses, the engagement means acting to restrain their disengagement; the outer surfaces of said first and third flanges of the support providing support means for supporting the adjacent edge regions of the pair of cladding elements; and wherein each support extends in use for at least a substantial part of the width of a cladding element and provides support for both of the adjacent pair of cladding elements over at least a substantial part of the width of each.

2. A cladding assembly according to claim 1 wherein the tongue of each support is arranged so that a first hook formation of a cladding element can be offered up to hook behind the tongue of a support when the element is projecting away from its cladding configuration, whereafter the element can be moved to its cladding configuration, with its second hook formation then engaging a tongue of an adjacent support which already engages the first hook formation of a further element.

3. A cladding assembly according to claim 2 wherein said second hook formation and tongue are adapted to be snap-engageable together.

4. A cladding assembly according to claim 1 wherein each cladding element has a second pair of opposed edges extending transversely of the edges which provide the hook formations, and there are adjacent said second pair of edges respective regions with mutually complementary rib and socket formations whereby laterally adjacent elements are engageable with overlap of respective regions.

5. A cladding assembly according to claim 1 wherein each cladding element has a main cladding portion which extends generally in a plane between said first and second hook formations; said first hook formation comprises a flange extending outwardly away from said main cladding portion so as to be engageable behind said tongue of a support; and said second hook formation comprises a flange extending inwardly away from said main cladding portion and terminating with a rearwardly projecting lip, said second hook formation being adapted to overlie said tongue with its flange, with its hook engaging beneath the edge of said tongue.

6. A cladding assembly according to claim 1 wherein each cladding element has ribs projecting beneath it for engaging the third flange of a respective profile.

* * * * *